US006609400B2

(12) United States Patent
Luker

(10) Patent No.: US 6,609,400 B2
(45) **Date of Patent: *Aug. 26, 2003**

(54) DELAYED EGRESS SYSTEMS

(76) Inventor: Graham James Luker, 21/21-25 Bourke Road, Cronulla New South Wales (AU), 2230

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/563,689

(22) Filed: May 3, 2000

(65) Prior Publication Data

US 2002/0144525 A1 Oct. 10, 2002

(51) Int. Cl.[7] ..... E05B 65/10

(52) U.S. Cl. ..... 70/92; 70/257; 49/25; 292/251.5

(58) Field of Search ..... 70/92, 257, 267, 70/270, 277; 292/251.5, 92; 49/25, 31

(56) References Cited

U.S. PATENT DOCUMENTS

| | | | | | |
|---|---|---|---|---|---|
| 409,508 | A | * | 8/1889 | Schenke | |
| 1,979,497 | A | * | 11/1934 | Schneider et al. | |
| 3,242,708 | A | * | 3/1966 | Sanchez | |
| 3,443,339 | A | * | 5/1969 | Goldstein | |
| 4,612,729 | A | * | 9/1986 | Sato | 49/362 |
| 4,703,962 | A | * | 11/1987 | Kelly et al. | 292/251.5 |
| 4,720,128 | A | * | 1/1988 | Logan, Jr. et al. | 292/251.5 |
| 4,763,937 | A | * | 8/1988 | Sittnick, Jr. et al. | 292/251.5 |
| 4,871,204 | A | * | 10/1989 | Cook et al. | 292/251.5 |
| 4,893,852 | A | * | 1/1990 | Harris et al. | 292/251.5 |
| 4,929,005 | A | * | 5/1990 | Heinen | 292/251.5 |
| 5,184,855 | A | * | 2/1993 | Waltz et al. | 292/251.5 |
| 5,429,399 | A | * | 7/1995 | Geringer et al. | 292/92 |
| 6,049,287 | A | * | 4/2000 | Yulkowski | 340/693.12 |
| 6,259,352 | B1 | * | 7/2001 | Yulkowski et al. | 340/5.7 |

* cited by examiner

*Primary Examiner*—William A. Cuchlinski, Jr.
*Assistant Examiner*—Olga Hernandez
(74) *Attorney, Agent, or Firm*—Jacobson and Johnson

(57) ABSTRACT

There is a lock release apparatus for providing delayed passage past a movable barrier such as an exit door which is held to a closed position by a lock. The apparatus includes a beam transmitter, a beam receiver, a timer for releasing the lock after a predetermined delay, a trigger associated with the timer and a beam reflector affixed to an operating bar on the movable barrier. In use of the apparatus when the barrier is closed and locked the transmitter directs a beam onto the reflector at an orientation such that reflection is detected by the beam receiver when the operating bar is undisturbed. Subsequent movement of the operating bar to open the barrier terminates or shifts the reflection away from the receiver to trigger the timer to release the lock after the predetermined delay.

11 Claims, 1 Drawing Sheet

DELAYED EGRESS SYSTEMS

FIELD OF THE INVENTION

This invention relates to security locks. More particularly although not exclusively it discloses a lock release apparatus for providing delayed passage through a doorway or the like.

BACKGROUND OF THE INVENTION

With exit doors it is often necessary to provide a delayed egress system. While still allowing an exit such systems impose a predetermined delay between operation of the latch or push bar and the release of the door. With appropriate monitoring and alarms security staff are thereby allowed time to react before a person leaves the premises. Existing systems use a microwave or passive infrared beam motion detector which is directed downwardly in front of the door. Others use passive beams with micro switches and hard wiring through the doors or frames to communicate with the lock. Movement of persons attempting to use the door is detected and a timer is activated for release of the lock after a predetermined delay of say 15 seconds. The disadvantage of existing movement detecting systems is that the timer can be "fooled" into releasing the lock by passing a card, mirror or the like under the door from outside to intercept the beam. Extraneous light can also trigger the motion detectors to release the lock.

SUMMARY OF THE INVENTION

It is therefore an object of this invention to ameliorate the aforementioned disadvantages and accordingly a lock release apparatus for a movable barrier such as an exit door is disclosed, said apparatus including a pulled tuned active infrared a beam tramsmitter and receiver, timer means for releasing said lock after a predetermined delay, trigger means operatively connecting said timer means and said receiver for initiating operation of said timer means and reflector means associated with a latch handle, push bar or the like on said door, in use of the apparatus said transmitter being disposed to direct a beam onto said reflector at an orientation such that the reflection thereof is detected by said receiver and whereby movement of said handle, push bar or the like for exit terminates said reflection or shifts said reflection away from said receiver to thereby trigger said timing means to release the lock after a predetermined delay.

Preferably said beam is of a pulsed infrared light. The frequency of the pulses corresponds to the received tuned frequency. This insures that the received is only reacting to the transmitted signal. It also improved the power to range ratio.

It is further preferred that alarm means be activated during said predetermined delay.

BRIEF DESCRIPTION OF THE DRAWINGS

The currently preferred form of this invention will now be described with reference to the attached drawings in which.

DETAILED DESCRIPTION OF THE PREFERRED EMBODIMENTS

Figure 1:
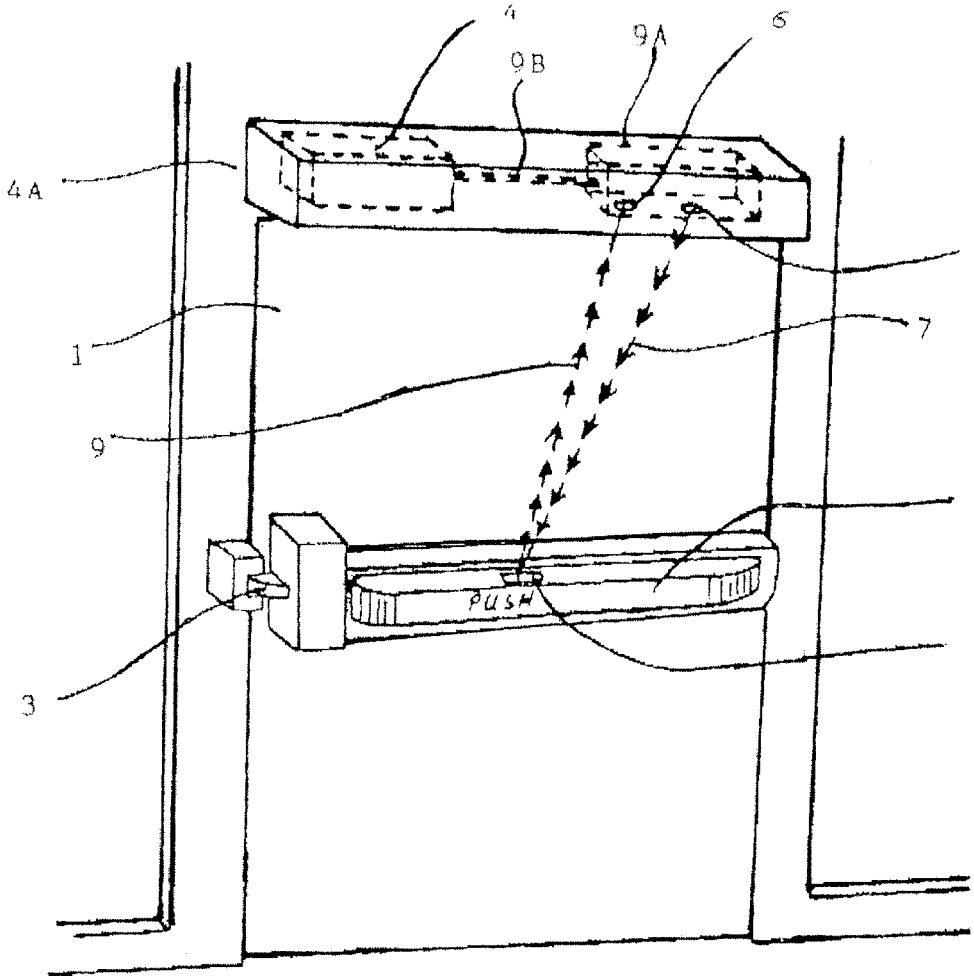
FIG. 1 is a schematic perspective view of an exit door fitted with a push-bar and delayed egress system according to this concept.

Referring first to FIG. 1 there is shown an exit door 1 with a push-bar 2 of any suitable design mounted across the inside. Upon depression of this bar the latch 3 is released. A security surface lock 4 is mounted to the door frame header 4A adjacent the outer edge of the door. Preferably but not essentially this lock is of the type described in the applicant's Australian patent 676629. This engages the top of the door and serves to keep it closed until the lock is released. An active infrared beam transmitter 5 and receiver 6 of any suitable design are also mounted on the door frame header adjacent the lock 4. The transmitter directs a preferably continuous beam 7 down onto a reflector plate 8 attached to upper surface of the push-bar 2. The positions of the transmitter 5, reflector plate 8 and receiver 6 are arranged such that during use of the apparatus with the door closed and the bar in its inoperative position the beam 7 is relected back along a path 9 detected by the receiver 6. In this mode the lock remains engaged and exit is denied. Upon depression of the bar 2 however the position and orientation of the reflector plate 8 is changed so that the beam is either no longer reflected or is reflected in a new direction which is out of alignment with and therefore undetected by the receiver 6. This triggers a timing circuit within the housing 9A which releases the lock 4 via control cable 9B after a predetermined delay of say 15 seconds. The design and construction of these trigger and timing circuits would be within the capabilities of a skilled technician and therefore are not described here in detail.

Preferably an audio alarm such as a beeping signal is activated with the timer so as to alert security that egress is being attempted. Upon release of the lock at the end of the delay period this alarm would preferably change to for example a continuous tone to indicate that exit has taken place. It is further preferred that once released the lock 4 remains disengaged until reset to allow immediate use of the door by security staff.

Monitors may also be fitted to advise security of door status (open/closed), lock status (engaged/disengaged), exit requests and tamper attempts.

Figure 2:
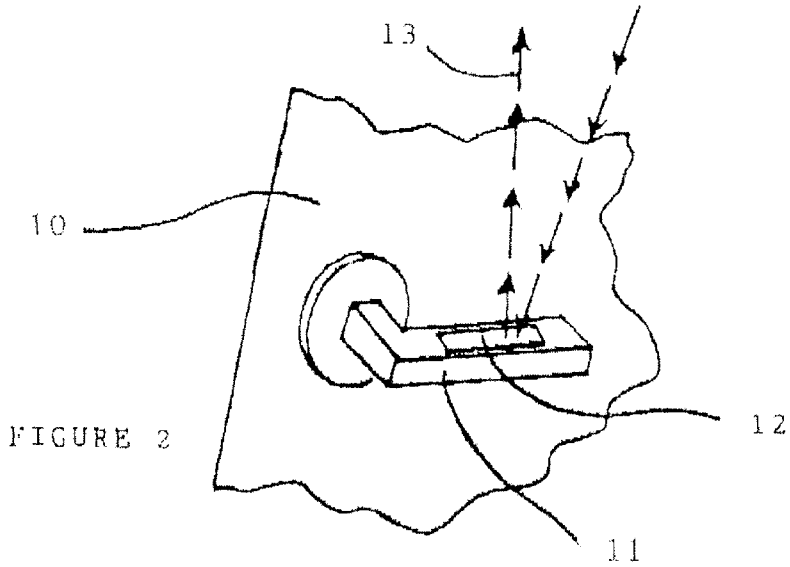
FIG. 2 shows an alternative position for the reflector plate on a door fitted with a latch handle.

With those doors 10 fitted with latch handles 11 instead of bars as shown in FIG. 2 the reflector plate 12 may be fitted to the upper surface of the handle. Grasping the handle and/or turning it therefore operates to block or change the direction of the reflected beam 13. The operation or the apparatus is otherwise the same as described with reference to FIG. 1.

It will thus be appreciated that this invention at least in the form of the examples described provides novel and useful improvements to delayed egress systems. The apparatus can be easily fitted to existing exits without major alteration and the range of the beam is easily adjusted for different sized doors. Further, as the beam is not influenced by movement or extraneous light it provides a greater measure of security. Clearly however the embodiments disclosed are only the currently preferred forms of the invention and a wide variety of modifications may be made within the scope of this concept. For example the invention is not limited to any specific components or circuits for the beam transmitter/receiver, trigger or timing circuits. The mounting and location of the apparatus may also be changed according to the nature of the installation.

What is claimed is:

1. A lock release apparatus for providing delayed passage past a movable baffler which is held to a closed position by a lock, said apparatus including a beam transmitter and receiver, a timer for releasing said lock after a predetermined delay, a trigger associated with said timer and a beam reflector affixed to an lock release operator on or adjacent said barrier, in use of the apparatus when the barrier is closed and locked the transmitter being disposed to direct a beam onto said reflector at an orientation such that reflection thereof is detected by said receiver when said lock release operator is undisturbed and whereby subsequent movement of said lock release operator to open said barrier terminates or shifts said reflection away from said receiver to thereby trigger said timer to release the lock after said predetermined delay.

2. The lock release apparatus as claimed in claim 1 wherein said beam is pulsed infrared light.

3. The lock release apparatus as claimed in claim 2 wherein the frequency of said pulsed infrared light corresponds to a tuned frequency of the receiver.

4. The lock release apparatus as claimed in claim 3 wherein said lock release operator is a latch handle or push bar fitted to said movable barrier.

5. The lock release apparatus as claimed in claim 4 wherein said apparatus includes an alarm which is activated during said predetermined delay.

6. The lock release apparatus as claimed in claim 5 wherein said movable barrier is a door and said beam transmitter and receiver are mounted on a frame header for said door.

7. The lock release apparatus as claimed in claim 6 wherein said reflector is a reflector plate mounted on said latch handle or push bar.

8. The lock release apparatus as claimed claim 7 wherein said apparatus includes monitors to advise security staff of door and lock status.

9. The lock release mechanism as claimed in claim 8 wherein said lock is a surface lock mounted to the frame header adjacent the outer edge of said door.

10. The lock release apparatus as claimed in claim 9 wherein said lock when released remains disengaged until reset.

11. The lock release apparatus as claimed in claim 1 wherein said movable barrier is an exit door.

* * * * *